US005531319A

United States Patent [19]

Harrelson

[11] Patent Number: 5,531,319

[45] Date of Patent: Jul. 2, 1996

[54] BASKET-STYLE ARTICLE CARRIER WITH A SINGLE INTEGRAL PARTITION

[75] Inventor: Glen R. Harrelson, Roswell, Ga.

[73] Assignee: Riverwood International Corporation, Atlanta, Ga.

[21] Appl. No.: 391,900

[22] Filed: Feb. 21, 1995

[51] Int. Cl.[6] ..... B65D 75/00

[52] U.S. Cl. ..... 206/162; 206/170; 206/190; 206/175; 206/180

[58] Field of Search ..... 206/141, 142, 206/147, 148, 149, 152, 156, 162, 165, 167, 170, 172, 174, 175, 180, 183, 184, 185, 189, 193, 197, 200, 427; 294/87.2

[56] References Cited

U.S. PATENT DOCUMENTS

| | | | |
|---|---|---|---|
| 2,772,020 | 11/1956 | Kramer | 206/180 |
| 3,893,565 | 7/1975 | Rossi et al. | 206/183 |
| 4,205,748 | 6/1980 | Wilson | 206/174 |
| 4,782,944 | 11/1988 | Engdahl, Jr. | 206/185 |
| 5,167,325 | 12/1992 | Sykora | 206/143 |
| 5,234,103 | 8/1993 | Schuster | 206/156 |

*Primary Examiner*—Paul T. Sewell
*Assistant Examiner*—Tara L. Laster

[57] ABSTRACT

A basket-style carrier for packaging four bottles or other articles in two adjacent rows. A partition panel connected to opposite side panels is formed from a cutout in the body of a central handle panel. The layout, glue pattern and partition panel formation permits the carrier to be rapidly formed.

12 Claims, 3 Drawing Sheets

BASKET-STYLE ARTICLE CARRIER WITH A SINGLE INTEGRAL PARTITION

FIELD OF THE INVENTION

This invention relates to a basket-style carrier for packaging articles such as beverage bottles. More particularly, it relates to basket-style carrier for packaging four articles.

BACKGROUND OF THE INVENTION

Basket-style carriers are commonly employed to package beverage bottles. They typically include a separate cell for each bottle, from which the bottles can be readily removed, and a center handle panel for easily carrying the package. Contact between adjacent bottles is prevented by partitions which define the cells and by a center longitudinal partition in order to prevent breakage of the bottles. Normally, basket-style carriers of this type which are designed to hold four bottles are fabricated from blanks in which the side and end panels and the center handle panel are connected to each other in serial fashion to form an elongated rectangular arrangement, with the cell divider partitions being in the form of flaps connected to the top or bottom edge of the center handle panel. The formation of a carrier requires these flaps to be folded into place prior to the ends of the flaps being glued to the side panels to hold the partitions in place.

One problem with this arrangement is the extent to which the divider partition flaps extend transversely from the panel sections. This results in a web layout in which the blanks are relatively widely spaced from each other, resulting in a substantial amount of material usage. In addition, the relatively complicated gluing operation, made necessary by the transverse layout of the divider partition flaps, and the relatively slow speed of the moving web, made necessary by the need to initially fold the cell divider partition flaps into place, add to the cost of the carriers.

An object of the invention is to provide a four-bottle carrier which can be formed from a more efficient layout with respect to material usage and the required gluing pattern. Another object is to provide a carrier which is formed without first having to fold the cell divider partition flap into place before folding the side and end panels. A further object is to provide a carrier of this type which is capable of providing full protection to the packaged bottles.

BRIEF SUMMARY OF THE INVENTION

As is typical of basket-style carriers, the carrier of the invention comprises a bottom panel, side panels, end panels and a central handle panel. The handle panel is connected at opposite ends to the end panels, and a partition panel, formed from a cutout portion in the handle panel, is connected at opposite ends to the side panels. A fold line connects the partition panel to the handle panel.

In a preferred arrangement the fold line connecting the partition panel to the handle panel is a substantially vertical fold line located substantially centrally of the carrier and is comprised of spaced upper and lower segments. Both the handle panel and the partition panel include solid portions and cutout portions on opposite sides of the fold line segments, the solid portions of each panel being formed from the cutout portion of the other panel.

The carrier is formed from an elongated blank which includes a partial end panel at one end and a handle panel section at the other end. The blank can be rapidly folded and glued to form a collapsed carrier which subsequently is opened during the packaging operation.

These and other features and aspects of the invention will be readily ascertained from the detailed description of the preferred embodiment described below.

DETAILED DESCRIPTION OF THE PREFERRED EMBODIMENT

Figure 1:
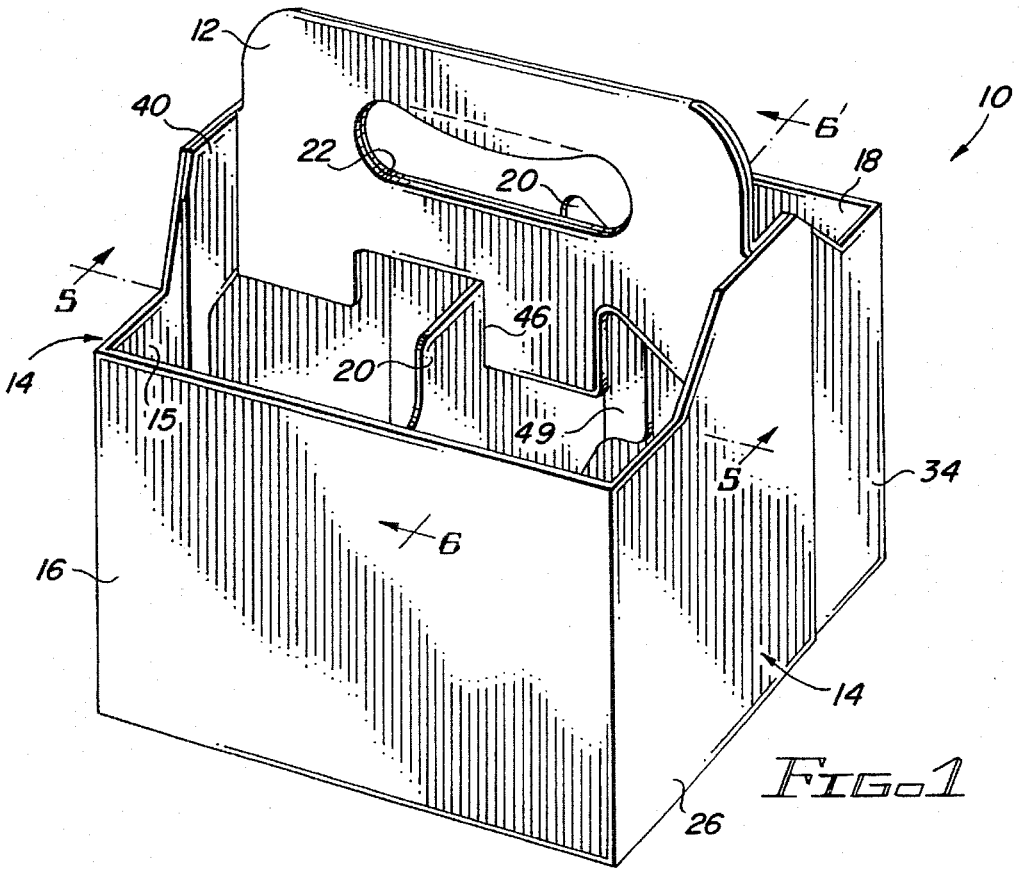
FIG. 1 is a pictorial view of a basket-style carrier incorporating the invention.

Referring to FIG. 1, the basket-style carrier 10 of the invention includes a central handle panel 12 connected to end panels 14. The end panels are connected to side panels 16 and 18, and the side panels are connected to a bottom panel, not visible in this view. Individual cells for receiving bottles or other articles are formed by transverse partitions 20 which extend from the side panels to the handle panel 12. The handle panel includes a handle opening 22. Because there are only two similar cells on opposite sides of the handle panel, the length and width of the carrier are the same. Additional features of the carrier indicated by other reference numerals in this drawing figure will be referred to below in connection with other drawing figures.

Figures 2, 3:
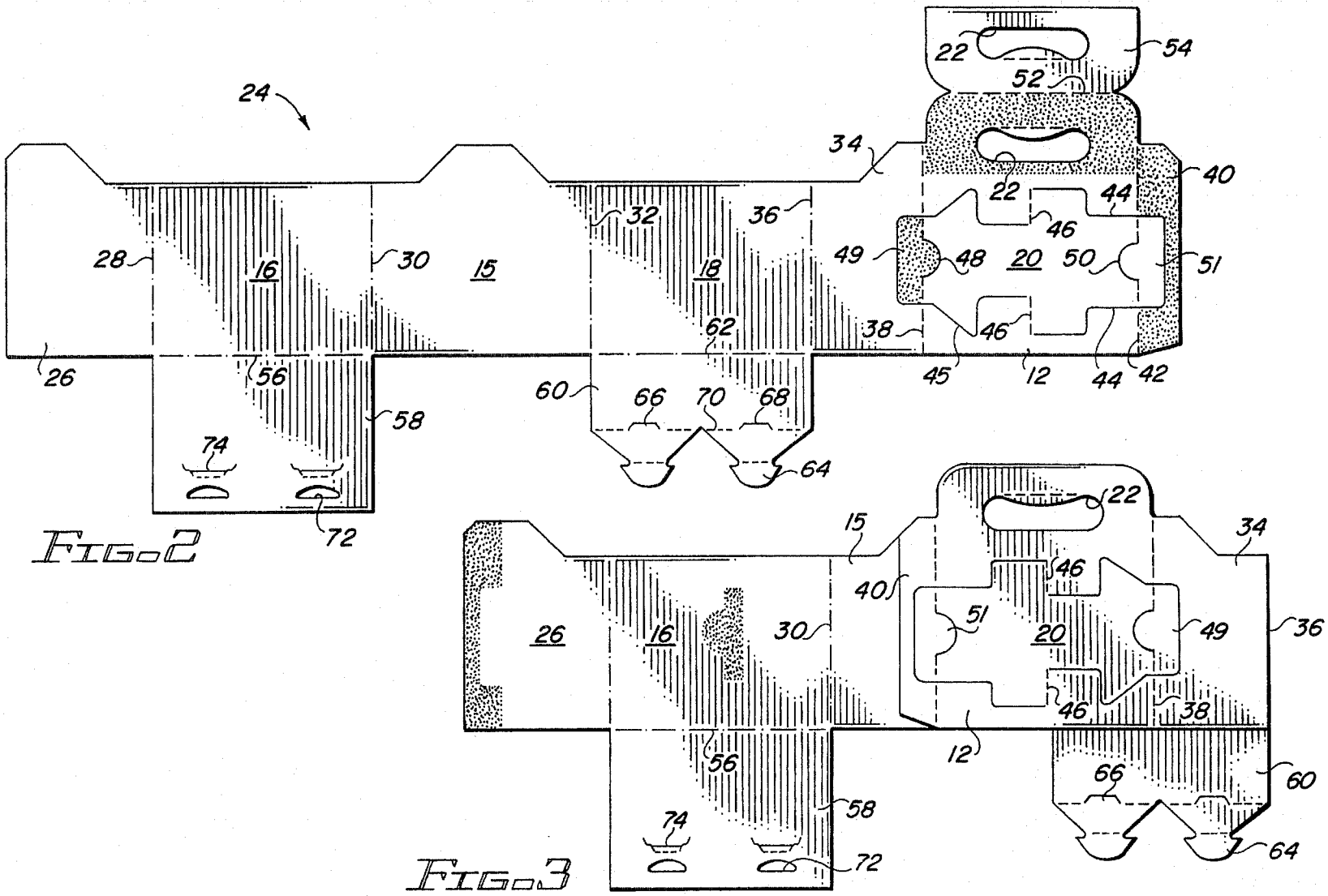
FIG. 2 is a plan view of a blank for fabricating the carrier.
FIG. 3 is a plan view of the carrier blank after an initial folding step.

Referring to FIG. 2, wherein like reference numerals to those used in FIG. 1 denote like elements, a blank 24 is shown as being of generally elongated rectangular shape with bottom panel flaps and a handle flap extending transversely from the basic shape. At one end of the blank partial end panel flap 26 is connected by fold line 28 to side panel section 16, which in turn is connected by fold line 30 to end panel section 15. The other side panel section 18 is connected to the end panel section 15 by fold line 32 and to partial end panel section 34 by fold line 36. At the other end of the blank the handle panel section 12 is connected to the partial end panel section 34 by fold line 38 and to glue flap 40 by fold line 42.

The partition section 20 is formed by two continuous slits 44 and 45, each of which extends across half the width of the handle panel section 12, the slit 44 terminating in the glue flap 40 and the slit 45 in the partial end panel section 34. Aligned vertical fold lines 46 connect the spaced ends of the slits 44 and 45 at a point substantially midway between the fold lines 38 and 42. The fold lines 42 and 38 cross the slits 44 and 45, respectively, terminating at arcuate slits 48 and 50 to form partition glue flaps 49 and 51. Connected by fold line 52 to the upper edge of the handle panel section 12 is a handle panel extension 54 which, like the handle panel section 12, contains a handle opening 22.

Connected to the lower edge of the side panel section 16 by fold line 56 is inner bottom panel flap 58, while outer bottom panel flap 60 is connected to the lower edge of the side panel section 18 by fold line 62. The outer bottom panel flap 60 includes secondary locking tabs 64 and primary locking tabs 66, the latter being formed by slits 68 which interrupt fold line 70. Primary locking openings 72 and secondary locking slits 74 are provided in the bottom panel flap 58 to receive the primary and secondary locking tabs.

The fold lines 28, 30, 32, 36, 38 and 42 are parallel to each other and extend vertically in a carrier formed from the blank, while the fold lines 56 and 62 are aligned with the lower edges of the main rectangular body of the blank and form substantially right angles with the vertical fold lines.

To form a carrier from the blank glue is applied to the upper portion of the handle panel section 12, to the glue flap 40 and to the glue flap 49, as shown in stipple in FIG. 2. No glue is applied to the glue flap 51. The handle panel extension 54 is folded down about the fold line 52 to adhere it to the upper portion of the handle panel section 12 so as to make the area surrounding the aligned handle openings 22 of two-ply construction. The portion of the blank to the right of the fold line 36 is then pivoted about the fold line 36 to the interim configuration shown in FIG. 3. In this manner the glue flap 40 is adhered to the end panel section 15 and the glue flap 49 is adhered to the underlying side panel section 18.

Figure 4:
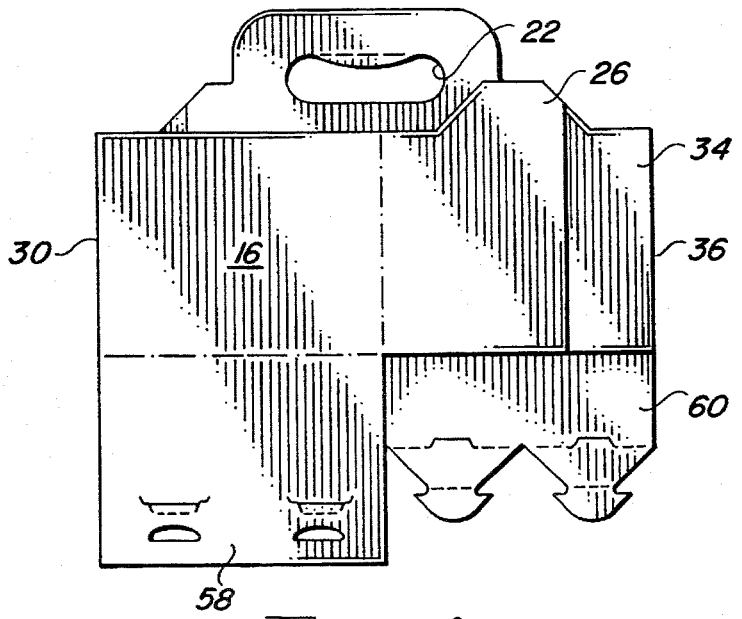
FIG. 4 is a plan view of a collapsed carrier resulting from a final folding step.

Glue is then applied to the edge portion of the end panel flap 26 shown in stipple in FIG. 3 and to the central portion of the side panel section 16, also shown in stipple, after which the left portion of the blank is pivoted about fold line 30 to form the collapsed carrier shown in FIG. 4. This brings the glue on the end panel flap 26 into contact with the portion of the partial end panel section 34 surrounding the glue flap 49, and the glue in the side panel section 16 into contact with the glue flap 51. After the collapsed carrier is squared up by applying opposed inward pressure to the end folds 30 and 36, it only remains for the bottom panel of the carrier to be formed.

The particular design of the bottom panel of the carrier is not a feature of the invention, and the bottom panel may therefore be of any suitable design. As to the formation of the bottom panel from the blank design shown, it will be understood by those familiar with the carrier art that after the collapsed carrier has been squared up the bottom panel flaps 58 and 60 are folded so that the edge portion of the flap 60 overlaps the edge portion of the flap 58. By first folding the outer portion of the flap 60 back along the fold line 70 and then back again toward its normal planar position, the primary locking tabs 66 can be engaged with the straight edges of the locking openings 72. Then the secondary locking tabs 64 can be inserted into the slits 74 to prevent the primary locks from disengaging. Completion of the bottom panel results in the carrier of FIG. 1.

Figure 5:
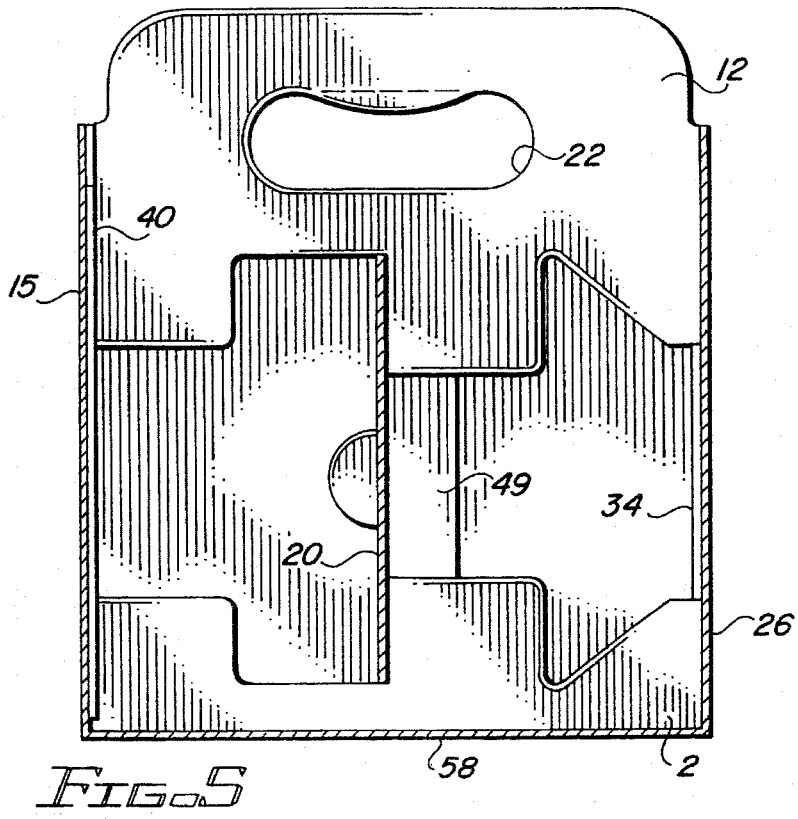
FIG. 5 is a sectional view taken along the line 5—5 of FIG. 1.
Figure 6:
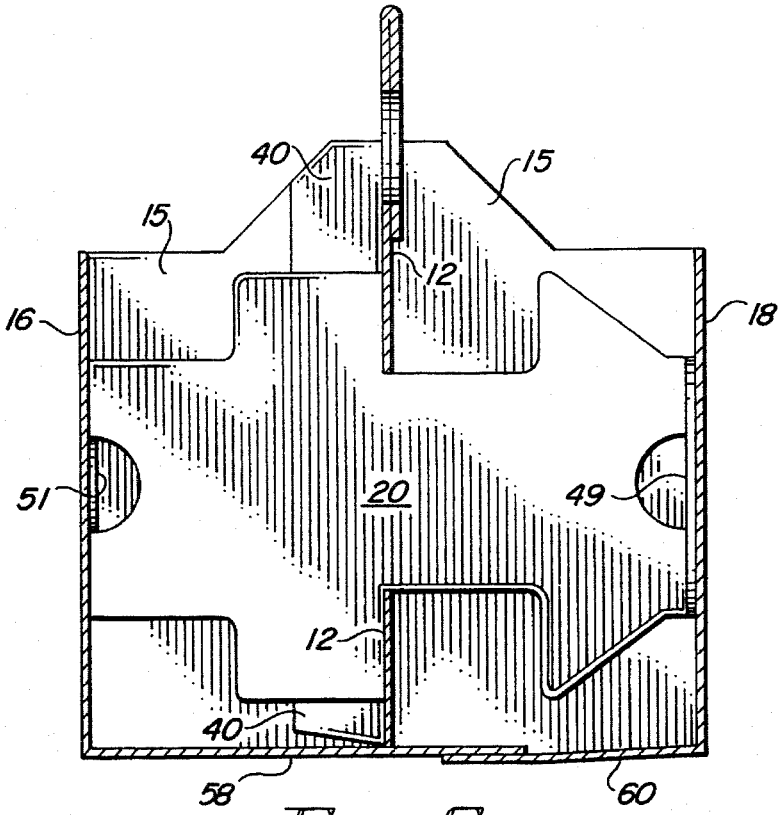
FIG. 6 is a sectional view taken along the line 6—6 of FIG. 1.

As best shown in FIGS. 1, 5 and 6, the handle panel 12 of the carrier is integrally connected to the partial end panel section 34 by the fold line 38 and is connected to the opposite end panel by the glue flap 40. The transverse partition 20 is integrally connected to the handle panel by the fold line segments 46 and to the side panels by the glue flaps 49 and 51. The result is a very sturdy carrier which provides effective bottle separation.

It will be understood that the specific shape of the partition 20 may vary from the design illustrated in the drawing. It is expected that the design be irregular in shape, however, in order to provide for the integral connection of the partition to the handle panel along the fold line 46 and to allow the partition to be punched out of the handle panel along the slits 44 and 45. In addition, the height of the partition should be such that the partition prevents adjacent bottles from contacting each other, while the remaining portion of the handle panel should also be of dimensions which are capable of preventing contact between adjacent bottles.

Because the partition 20 is formed from the body of the handle panel, the usual need to connect the partition to the upper or lower edge of the handle panel is eliminated, thereby eliminating substantial transverse projections of the blank. This allows the blank to be laid out in the web from which it is die cut so that the space between adjacent blanks is minimized, thus reducing material usage, and also eliminates the extra step required to fold the partition down when the partition is provided in the conventional form of a flap connected to the upper or lower edge of the handle panel. A further benefit of the design is that the gluing operation can be performed at high rates of speed. This is made possible by the fact that the blank is quite narrow, making the area over which glue is introduced quite narrow as well, thereby enabling the blanks to be moved past the glue heads at more rapid rates of speed than normal. Since this permits the carrier blanks to be formed at higher rates of speed, the cost of the operation is reduced.

Although the carrier has been described in connection with a basket-style carrier for packaging four bottles, it will be understood that it may be used to package other types of articles as well, particularly articles which should not be permitted to come into direct contact with each other.

The various design features described contribute to the ability to rapidly and economically produce an effective, strong basket-style carrier for holding four articles. It will be understood, however, that the invention is not limited to all the specific details described in connection with the preferred embodiment, except as they may be within the scope of the appended claims, and that changes to certain features of the preferred embodiment which do not alter the overall basic function and concept of the invention are contemplated.

What is claimed is:

1. A basket-style carrier for packaging four articles arranged in two adjacent rows, comprising:

a bottom panel;

a pair of opposite side panels connected to a pair of opposite end panels;

a central handle panel having opposite ends connected to the end panels;

a single partition panel extending transversely of the handle panel and connected thereto along a substantially vertical fold line located substantially midway between the end panels;

the handle panel containing a cutout portion from which the partition panel has been formed; and the partition panel extending continuously between the side panels and having opposite ends connected to the side panels.

2. A basket-style carrier as defined in claim 1, wherein both the handle panel and the partition panel include a solid portion and a cutout portion on opposite sides of said fold line, the solid portions of each of said panels being formed from the cutout portion of the other panel.

3. A basket-style carrier as defined in claim 1, wherein the fold line connecting the partition panel to the handle panel is comprised of spaced upper and lower aligned segments.

4. A basket-style carrier as defined in claim 3, wherein the upper segment of the fold line connecting the partition panel to the handle panel separates a solid section of the handle panel from a cutout portion of the handle panel and a solid section of the partition panel from a cutout portion of the partition panel, and the lower segment of said fold line separates a solid section of the handle panel from a cutout portion of the handle panel and a solid section of the partition panel from a cutout portion of the partition panel.

5. A basket-style carrier as defined in claim 1, wherein one of the end panels is comprised of an outer end panel flap overlapping and being adhered to an inner end panel flap, one end of the handle panel being integrally connected to the inner end panel flap by a fold line and the other end of the handle panel being connected to the end panel opposite said one end panel by a glue flap.

6. A basket-style carrier as defined in claim 5, wherein the opposite ends of the partition panel are connected to the side panels by glue flaps.

7. An elongated blank for forming a basket-style carrier for packaging four articles arranged in two adjacent rows, comprising:

an end panel section having opposite substantially parallel transverse edges;

a first side panel section connected along an edge to one of the transverse end panel section edges and a second side panel section connected along an edge to the other transverse end panel section edge, the side panel sections being of equal length;

a first partial end panel section connected to the first side panel section opposite the edge thereof connected to the end panel section;

a second partial end panel section connected to the second side panel section opposite the edge thereof connected to the end panel section;

a handle panel section connected to the second partial end panel section opposite the edge connected to the second side panel section, the handle panel section having a length substantially equal to the length of the side panel sections;

the handle panel section containing a slit defining a single partition panel connected to the handle panel section by a fold line, said fold line being substantially parallel to the parallel transverse edges of the end panel section and being spaced from the second partial end panel section by an amount substantially equal to half the length of the handle panel section;

means connected to the blank for forming a bottom panel in a carrier formed from the blank; and means for connecting the partition panel to opposite side panels of such a carrier.

8. A basket-style carrier blank as defined in claim 7, wherein the means for forming a bottom panel is comprised of at least one bottom panel flap connected to one of the side panel sections along a fold line extending transversely of the edge of the side panel section connected to the end panel section.

9. A basket-style carrier blank as defined in claim 7, wherein the means for forming a bottom panel is comprised of a bottom panel flap connected to each of the side panel sections along substantially aligned fold lines extending transversely of the edges of the side panel sections connected to the end panel section.

10. A basket-style carrier blank as defined in claim 7, wherein said fold line extends between spaced ends of the slit and is comprised of spaced upper and lower aligned segments.

11. An elongated blank for forming a basket-style carrier for packaging four articles arranged in two adjacent rows, comprising:

an end panel section having opposite substantially parallel transverse edges;

a first side panel section connected along an edge to one of the transverse end panel section edges and a second side panel section connected along an edge to the other transverse end panel section edge;

a first partial end panel section connected to the first side panel section opposite the edge thereof connected to the end panel section;

a second partial end panel section connected to the second side panel section opposite the edge thereof connected to the end panel section;

a handle panel section connected to the second partial end panel section opposite the edge connected to the second side panel section;

the handle panel section containing a slit defining a partition panel connected to the handle panel section by a fold line;

means connected to the blank for forming a bottom panel in a carrier formed from the blank; and a glue flap extending from opposite ends of the partition panel for connecting the partition panel to opposite side panels of a carrier formed from the blank, the slit defining the partition panel extending beyond the handle panel section to define the glue flaps.

12. A basket-style carrier blank as defined in claim 11, wherein the glue flap connected to one of the ends of the partition panel is formed in the second partial end panel section and the glue flap connected to the other of the ends of the partition panel is formed in a larger glue flap connected to the handle panel section.

* * * * *